United States Patent [19]

Fuhrmann et al.

[11] 4,287,745

[45] Sep. 8, 1981

[54] ROLLING MILL SCREWDOWN

[75] Inventors: Wilhelm Fuhrmann, Wexford; Andrew J. Sofranko, Pittsburgh, both of Pa.

[73] Assignee: Schloemann-Siemag, Inc., Pittsburgh, Pa.

[21] Appl. No.: 31,887

[22] Filed: Apr. 20, 1979

[51] Int. Cl.[3] ..... B21B 31/24

[52] U.S. Cl. ..... 72/248

[58] Field of Search ..... 72/248, 237, 238

[56] References Cited

U.S. PATENT DOCUMENTS

| | | | |
|---|---|---|---|
| 693,031 | 2/1902 | Kennedy | 72/248 |
| 2,045,768 | 6/1936 | Gassen | 72/248 |
| 3,415,097 | 12/1968 | Wheeler | 72/248 |

FOREIGN PATENT DOCUMENTS

| | | | |
|---|---|---|---|
| 628873 | 6/1969 | Belgium | 72/248 |
| 839712 | 5/1952 | Fed. Rep. of Germany | 72/248 |
| 2652325 | 5/1978 | Fed. Rep. of Germany | 72/248 |
| 2743560 | 3/1979 | Fed. Rep. of Germany | 72/248 |
| 1492746 | 7/1967 | France | 72/248 |

*Primary Examiner*—Milton S. Mehr

*Attorney, Agent, or Firm*—Thomas H. Murray; Clifford A. Poff

[57] ABSTRACT

A screwdown is replaceably inserted in the window of a rolling mill housing between a bearing chock and a surface defining the window of the housing. The screwdown which is provided for each of the pair of rolling mill housings includes a screwdown housing carrying a nut member which receives a screw which is locked against rotation by a lock plate supported by the screwdown housing. Gear teeth are formed on the outer cylindrical surface of the nut and these teeth mesh with the teeth of a worm gear on a shaft which is supported by the screwdown housing for rotation. The shaft of one screwdown housing is coupled to a torque shaft which extends through and supported by the other screwdown housing. The shafts are releasably locked together for synchronous or independent rotation.

18 Claims, 6 Drawing Figures

ROLLING MILL SCREWDOWN

BACKGROUND OF THE INVENTION

This invention relates to a screwdown in the form of an assembly for removable use as an integral component of a rolling mill to adjust the gap between a pair of processing rolls, and more particularly to such a screwdown embodying a construction and arrangement of parts to occupy a minimum of space within the windows of the mill housings while supported by the housings to transmit rolling forces from the roll positioned thereby to the mill housing.

As is well known in the rolling mill art, a screwdown is the mechanical system in a rolling mill used to adjust the gap between processing rolls for workpieces. Bars, billets, rods and similar workpieces are usually processed in a 2-high rolling mill after the gap between the rolls is established by operating the screwdown. Because of the nature of the rolling operation, it is usually unnecessary to operate the screwdown while the rolls engage the workpiece. A manually-operated screwdown is suitable for positioning one roll relative to the other in the absence of a rolling load; thus eliminating the need for massive and expensive motors.

A more economical rolling mill design is desired to minimize the capital investment required for rolling mills to process such workpieces. In a conventional rolling mill, the screwdown takes the form of screws threadedly received in nuts which are received in openings formed in the tops of the mill housings. One characteristic of a cast mill housing is the thickened or protruding areas at the top portion thereof to accommodate the rolling forces and provide support for the screwdown nut. The casting and machining operations require time, facilities and expenses, representative of a substantial cost to form cast mill housings. This cost can be minimized by an alternative fabrication procedure. A thick metal plate is usable after only machining operations to provide mill housings the necessary window openings and the like. Housings from metal plates are economically produced and capable of withstanding greater rolling loads with less weight.

Conventional screwdowns are costly both from the standpoint of the capital investment and necessary servicing operations, particularly mill downtime for servicing the screwdowns. When the screws for the screwdown extend through the tops of the mill housings, it is a time-consuming and laborious operation to remove each screw and/or nut from the bored openings in the housing tops. Efforts in the past to alleviate the problems associated with screwdowns in the tops of mill housings include the concept of interposing wedges between the top roll chock and the mill housing. By adjusting the position of one wedge with respect to the other within each housing window, the top roll assembly is moved toward or away from the lower roll assembly. However, such wedges are not an acceptable substitute for screwdowns, particularly because the relative position of one wedge with respect to the other and synchronous movement between the wedges are not sufficiently controllable. The rolling force transmitted by the wedges is translated into a lateral displacement component force acting on one or both of the wedges. Moreover, severe restrictions occur as to the distance through which adjustment of the rolls relative to each other can occur. These shortcomings, together with the excessive demands for lubrication and other maintenance, render the concept of wedges unsuitable for use in such rolling mills. To alleviate these and other problems arising out of the need for apparatus to adjust the position of one roll relative to another roll in the rolling mill, the present invention provides readily-servicable and independent screwdown assemblies for support wholly within the window of each mill housing of the rolling mill.

SUMMARY OF THE INVENTION

It is an object of the present invention to provide a screwdown for a rolling mill having spaced-apart mill housings with windows therein to receive and support bearing chocks on the ends of at least a pair of rolls with one roll being adjustable relative to the other roll by means of screwdown units each insertable into a housing window and attached to the housing for removable support while carrying screw and nut members adapted for relative rotation to position one of the rolls.

It is a further object of the present invention to provide a rolling mill screwdown wherein screwdown housing members are removably attached to the mill housings while carrying a nut member threadedly engaged with a screw which is retained against rotation relative to the nut member by a locking plate supported by the screwdown housing, the arrangement of parts being further characterized by the fact that an outer cylindrical surface of the nut member is provided with gear teeth to mesh with a worm gear having a drive shaft arranged such that one of the screwdown housing members supports the drive shafts for both of the screwdown housing members.

It is a further object of the present invention to provide a rolling mill screwdown for detachable support within the windows of mill housings each machined from a steel plate to form a surface for defining part of the housing window upon which a mill screwdown is attachably supported to engage the bearing chocks of one of a pair of roll assemblies to adjust the gap therebetween.

More particularly, according to the present invention, there is provided a rolling mill including spaced-apart mill housings each having a window to receive and support a bearing chock on one of the ends of each of at least a pair of rolls for processing workpieces, the combination therewith of screwdown housing means extending within the windows of the mill housings between the bearing chocks for one roll and the mill housing, nut members carried by the screwdown housing means, a pair of screws each threadedly engaged with one of the nut members, means carried by the screwdown housing means for producing relative rotation between the screws and nut members, locking means supported by the screwdown housing means for linearly constraining the displacements of the pair of screws relative to the nut members by relative rotation therebetween, and fastening means to releasably attach the screwdown housing means onto the mill housings within the windows thereof such that the nut members and the screws extend between the chocks of one roll and the mill housings for adjustably positioning one roll relative to the other roll.

According to the present invention, the aforementioned screwdown housing means are constructed for support by the mill housings within the top of the housing window or, alternatively, in the bottom of the housing window whereby the upper roll of the rolling mill is adjusted relative to the lower roll in the first instance; and in the second instance, the lower roll is adjusted relative to the upper roll. The combination of parts to provide the rolling mill screwdown in either instance is preferably further characterized by the fact that the length of each of the aforesaid screws is less than the height of either the top or bottom beam section of the mill housing which includes post sections joining together the beam sections. The threaded length of each screw is no greater than the threaded length of each nut member whereby the screwdown occupies a minimum of space when operatively arranged within the housing windows to enable the utilization of more compact and efficient mill housings. Preferably, the aforesaid screwdown housing means comprise discrete screwdown housing members each having a width which is greater than the thickness of either of the mill housings for support through the provision of brackets attached to the side faces of the mill housings. The brackets removably support threaded fasteners extending into the screwdown housing members. Preferably, the window of each of the mill housings is defined by a generally planar surface engaged by one of the screwdown housing members. To achieve a compact screwdown, the screw member thereof is retained against rotation by using the screwdown housing to anchor a plate member engageable with the screw to restrict movement thereof to linear displacements relative to the nut. The nut, having internal screw threads, also includes concentrically-disposed, but outwardly spaced, gear teeth that mesh with a worm gear having a drive shaft supported for rotation within the screwdown housing. The drive shafts in the two screwdown housing members are arranged in the mill housings for access from one side thereof, e.g., the operator's side, by providing that the drive shaft of the screwdown in the mill housing at the drive side is extended by coupling a torque shaft thereto through the screwdown housing member at the operator's side. The arrangement of parts at the operator's side is such that the drive shafts for both screwdowns are parallel and either concentric or laterally displaced from one another. Synchronous movement of both screwdowns is achieved by coupling together the drive shafts.

These features and advantages of the present invention as well as others will be more fully understood when the following description is read in light of the accompanying drawings, in which.

Figure 1:
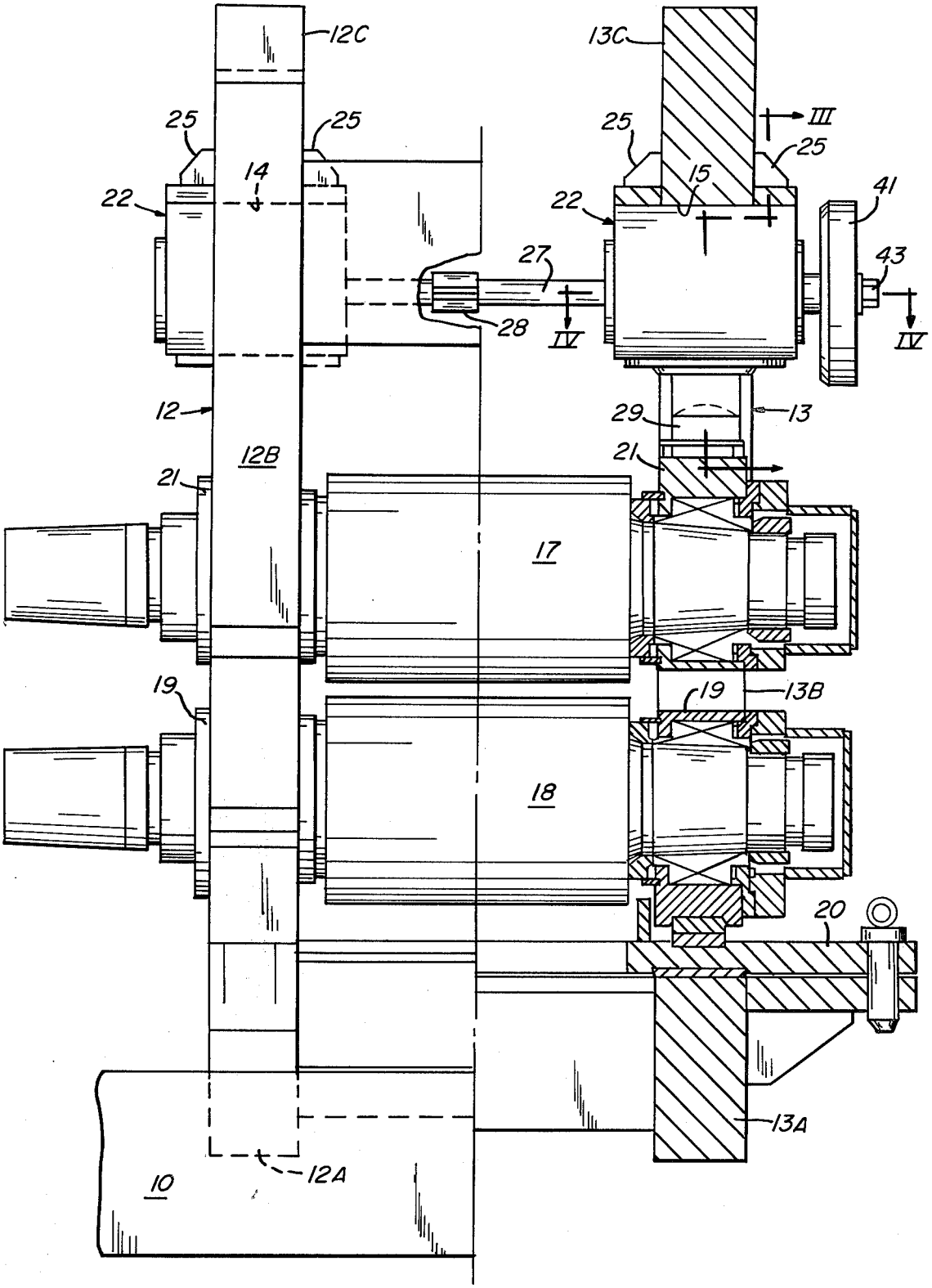
FIG. 1 is a front elevational view, in section at the operator's side, of a rolling mill embodying the screwdown of the present invention.
Figure 2:
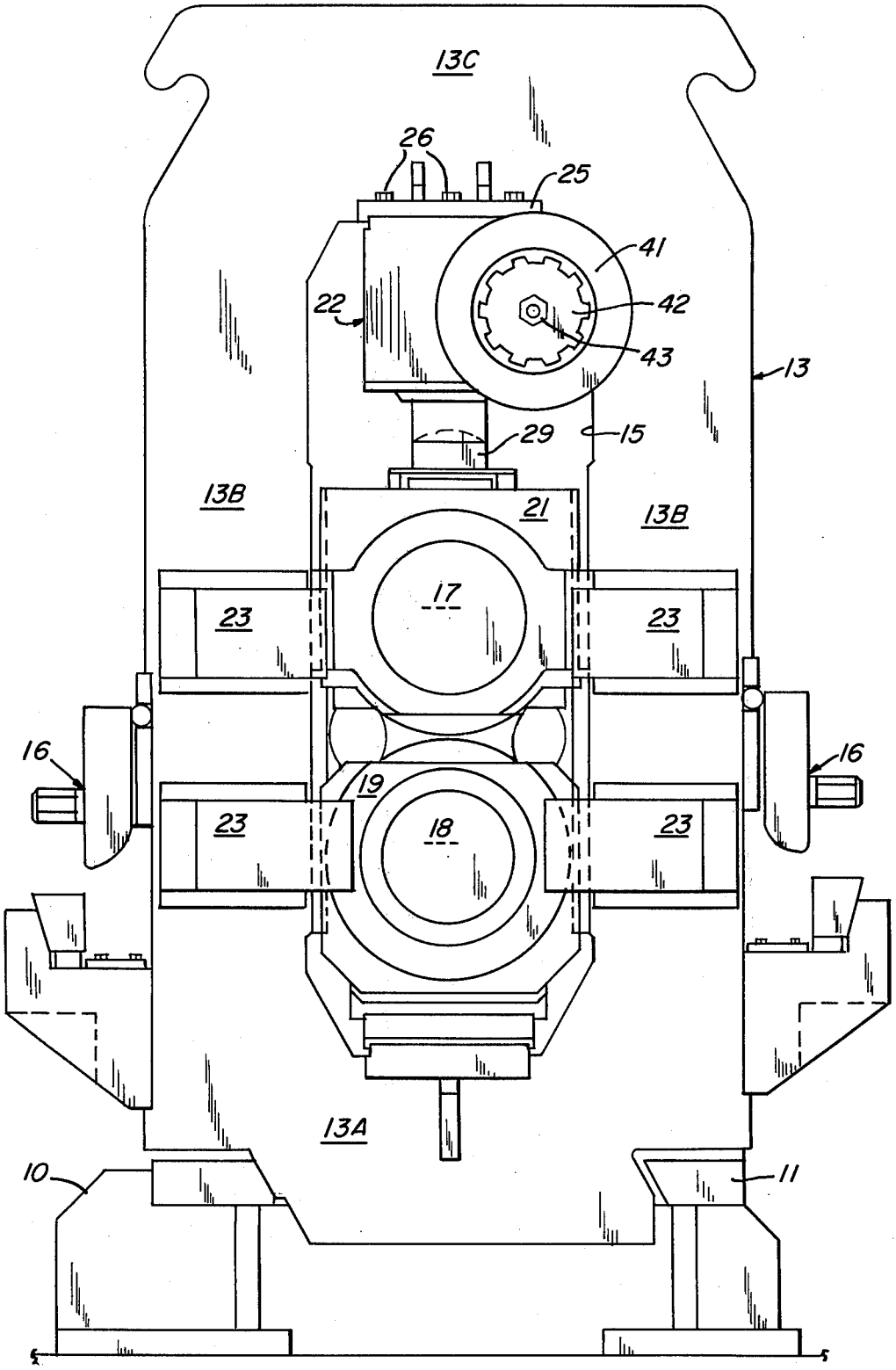
FIG. 2 is an end elevational view from the operator's side of the rolling mill shown in FIG. 1.

In FIGS. 1 and 2, there is illustrated a 2-high rolling mill for processing bars, billets, rods and the like workpieces, although the mill may be used to process other designated forms of workpieces such as currently processed in a merchant mill or other mill using grooved rolls. The rolling mill shown in FIGS. 1 and 2 includes bedplates 10 and 11 which carry spaced-apart mill housings 12 and 13 having windows 14 and 15, respectively. It is preferred to manufacture the mill housings 12 and 13 from steel plate to minimize the size and weight of the housings without sacrificing strength. Rest bars and guides 16 are conventionally used at the entry and delivery sides of the mill, although they do not form a part of the present invention. Upper and lower rolls 17 and 18 are supported by the mill housings at opposite sides of a passline. The lower roll 18 is rotatably supported by bearing chocks 19 that rest on a sled 20. The sled is supported by the mill housings for use during roll changing operations to carry the rolls into and out of the mill housings. The sled 20 transmits rolling forces from the bearing chocks to bottom beam sections 12A and 13A of the mill housings. These beam sections are joined by housing posts 12B and 13B to top beam sections 12C and 13C, respectively. The upper roll 17 is supported by bearing chocks 21 that are received in the housing windows and engaged by screwdown assemblies 22, also located within the housing windows, for adjustably positioning the roll 17 relative to the roll 18. At the operator's side, the chocks 19 and 21 are retained against axial movement in the housing windows by keeper plates 23.

The screwdown assemblies 22 rest against the surface of the housing which defines the upper limit to the housing windows, and as will be described in greater detail hereinafter, brackets 25 are attached such as by weld metal so as to provide lateral housing support surfaces for the screwdowns. Fasteners, such as bolts 26, are passed through openings in the brackets 25 into tapped holes formed in the screwdown assembly. As will be described in greater detail hereinafter, a torque shaft 27 with a coupling 28 forms the only interconnection between the screwdowns when operatively supported by the housings. By the provision of coupling 28, either or both of the screwdowns is readily detachable from its operative location in the mill for removal and if necessary the insertion of a replacement screwdown assembly. In this way, periodic maintenance as well as repairs may be carried out at a convenient time after the mill is returned to production status. While not essential to the present invention, it is preferred to use pressure blocks 29 between the screwdowns 22 and the chocks 21 of the upper roll.

Figure 3:
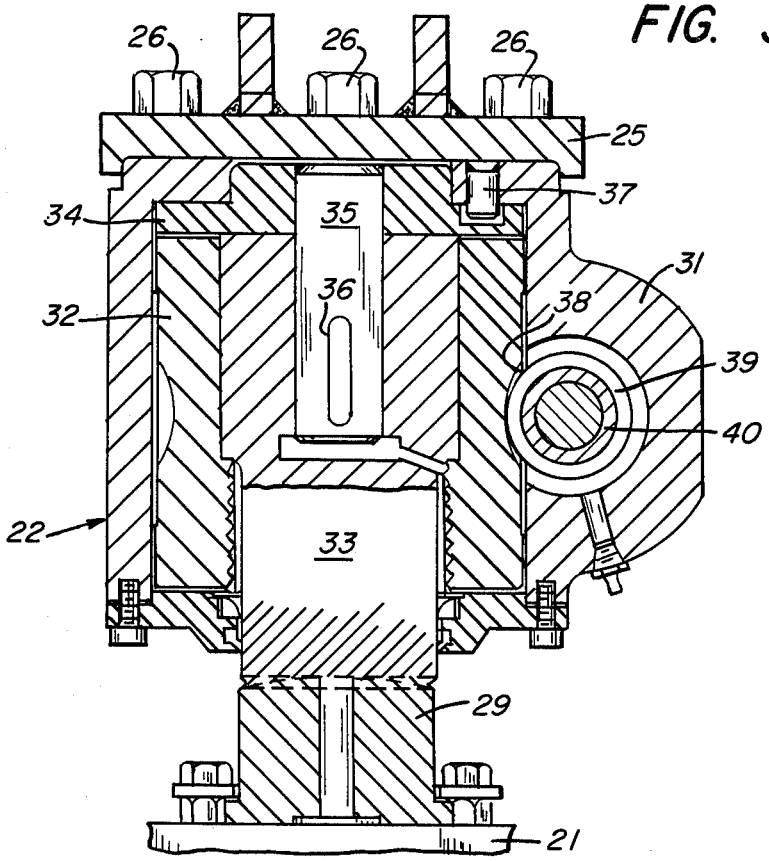
FIG. 3 is a sectional view taken along line III—III of FIG. 1.
Figure 4:
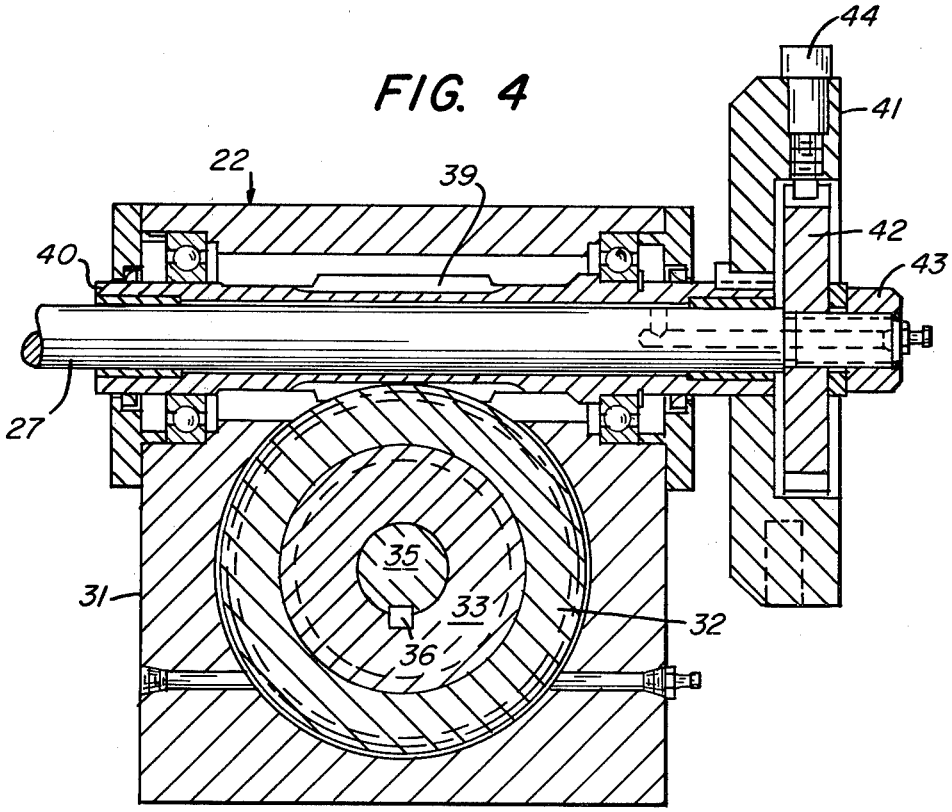
FIG. 4 is a sectional view taken along line IV—IV of FIG. 1.

In FIGS. 3 and 4, there is illustrated the details of the construction of the screwdowns used in the housing windows for adjusting the upper roll 17. The screwdown assembly shown in FIGS. 3 and 4 is used at the operator's side of the mill and embodies the same essential parts as the screwdown used at the drive side of the mill. As shown, the screwdown 22 includes a housing 31 having an annular recess into which there is received a nut 32 having threads which mate with the threads on a screw 33. The length of the threads on screw 33 is no greater than, actually less than, the length of the threads in nut 32. A pressure plate 34 transmits forces from the nut to the housing 31. The pressure plate 34 also serves as a locking member because secured within a bored opening therein is a pin 35 projecting into an axially-extending bored opening in screw 33. The pin 35 has a key slot receiving a key 36 extending into a longitudinal slot within the side wall of the bored opening in the screw. A locking pin 37 interconnects the housing 31 with pressure plate 34 to prevent relative rotation therebetween. In this way, the screw 33 is constrained to only linear displacements within the threaded opening of the nut. The nut, however, is rotated by meshing engagement of gear teeth 38, formed about the outer cylindrical surface of the nut, with the teeth of a worm gear 39. The worm gear is carried on a drive shaft 40. As shown in FIG. 4, the drive shaft 40 has a tubular configuration and receives the torque shaft 27 which is releasably connected by coupling 28 to the drive shaft for the worm gear in the screwdown at the drive side of the mill. The coaxial arrangement of the torque shaft 27 and drive shaft 40 provides convenient access to both shafts at the operator's side of the mill where shaft 40 is connected by a key to drive disc 41 having a central recess wherein a disc 42 is located while secured to torque shaft 27 by nut 43. A drive pin 44 extends through an opening in a rim portion of disc 41 to pass into one of a plurality of pockets formed about the outer peripheral surface of the disc 42. The drive pin as well as discs 41 and 42 form an interconnection for simultaneous rotation of the worm gears for both screwdowns. When it is necessary to level the mill, i.e., adjust one bearing chock of the upper roll relative to the other bearing chock, the drive pin 44 is removed whereby independent rotation of the worm gears is readily carried out by torque applied to either of the discs 41, 42.

Figure 5:
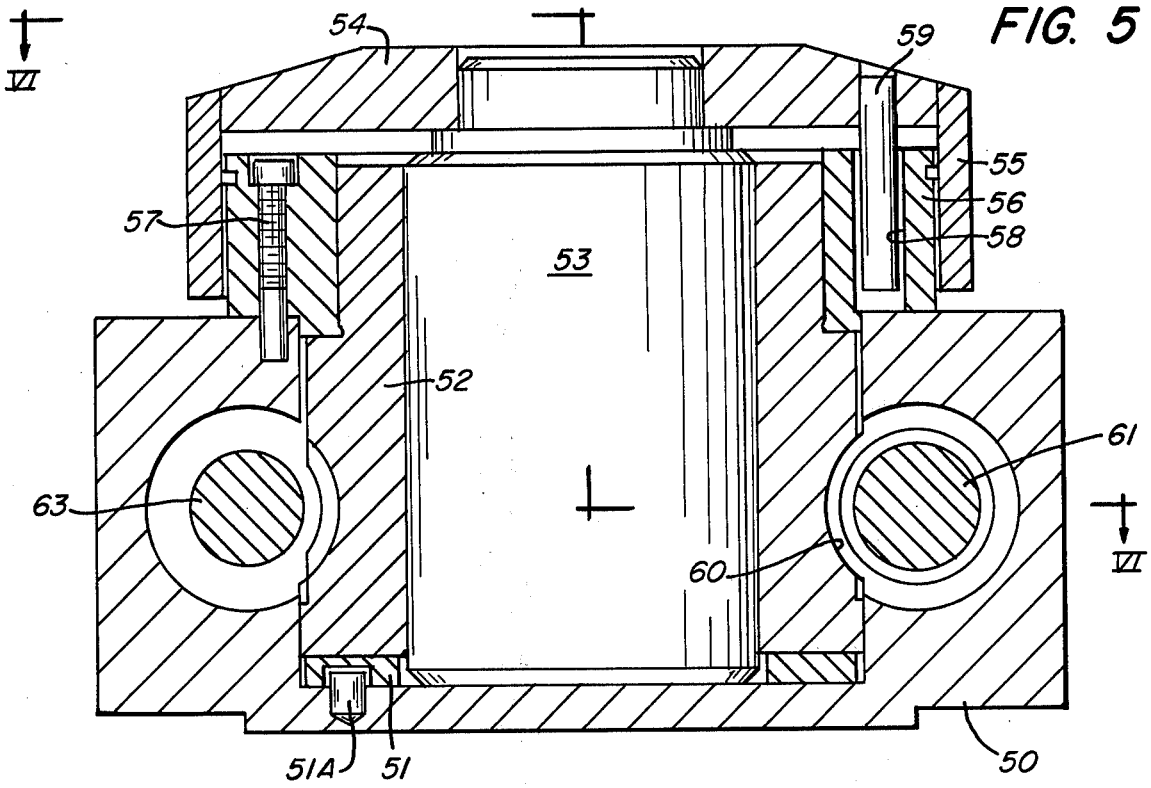
FIG. 5 is a view similar to FIG. 3 but illustrating a second embodiment of the screwdown according to the present invention.
Figure 6:
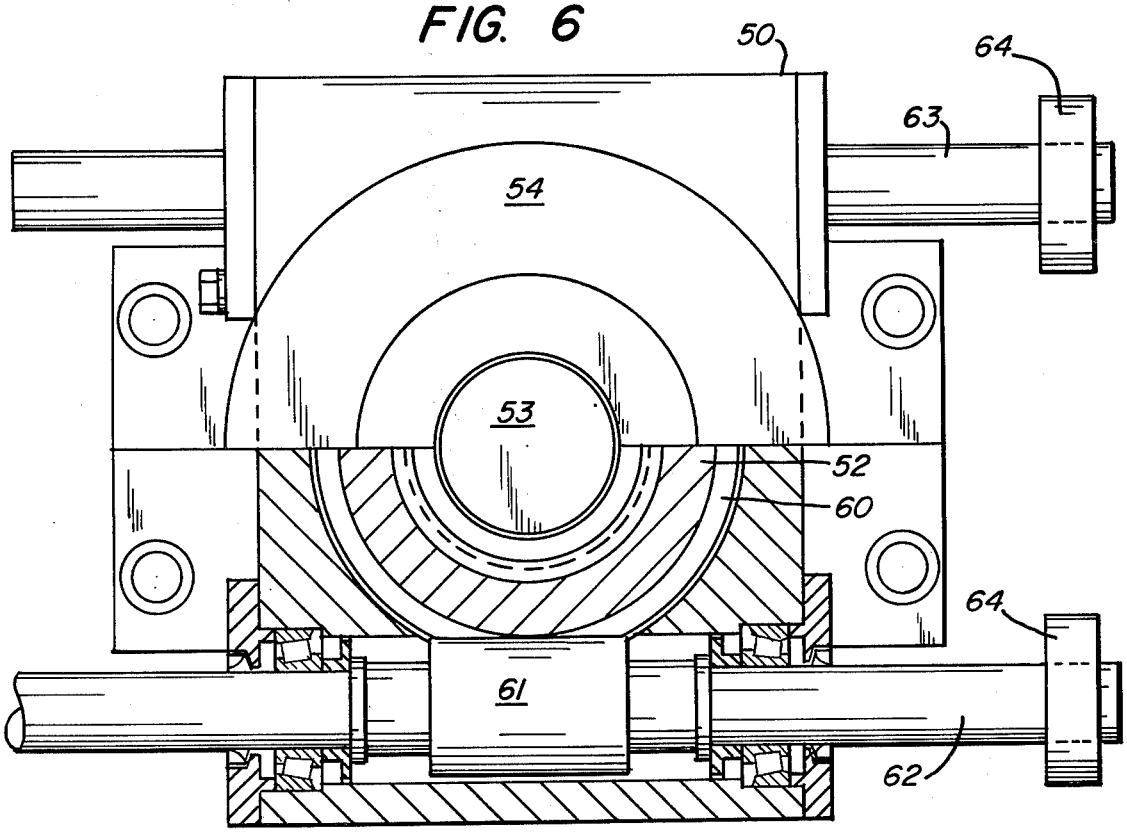
FIG. 6 is a partial sectional view taken along line VI—VI of FIG. 5.

FIGS. 5 and 6 illustrate a screwdown for use at the operator's side of the mill between the lower bearing chock and a sled or mill housing. In this embodiment of the screwdown, there is provided a screwdown housing 50 having a hollow recess into which a pressure ring 51 is secured against rotation by a pin 51A in the bottom of the recess. The top surface of ring 51 supports a nut 52 for rotation thereon. Internal threads of the nut mate with external threads on a screw 53 having a projected end with a load-bearing shoulder surrounding a pin section received within the opening of a locking plate 54. When operatively arranged in a rolling mill, the locking plate 54 contacts the bottom surface of the bearing chock while the screwdown housing 50 is supported by the sled in the housing window or by the mill housing. The locking plate 54 is attached to an annular ring 55 which slides along the outer surface of a nut retaining ring 56 constructed to be engaged in the recess formed in nut 52. Ring 56 is secured bo the housing 50 by a fastener bolt 57. The ring 56 includes a bored opening 58 extending parallel to the rotational axis of screw 53 but outwardly spaced therefrom. A pin 59, secured to locking plate 54, extends into recess 58 and forms a constraining interconnection between the screw 53 and the housing 50 whereby displacement of the screw is restricted to linear movement relative to the nut upon rotation of the latter. The nut has a cylindrical outer surface provided with gear teeth 60 that mesh with the teeth on a worm gear 61. The screwdown shown in FIGS. 5 and 6 is used at the operator's side of the mill and includes a drive shaft 62 for the worm gear 61. At the diametrically-opposite side of the nut, a torque shaft 63 is supported for rotation while coupled with the drive shaft for the worm gear in the screwdown at the drive side of the mill. As shown in FIG. 6, the drive shafts 62 and 63 are parallel and joined together for synchronous rotation by ratchet bars 64 which are interconnected by a link extending along a plane parallel with a plane containing the rotational axis of shafts 62 and 63.

In both embodiments of the screwdowns, the space required in each housing window, as represented by the overall height of the screwdown, is minimized by constraining the screw to only linear displacements and rotation of the nut member. The effective height of the screwdown and even the length of the screw are less than the height of either the upper or lower beam section of the mill housing.

Although the invention has been shown in connection with certain specific embodiments, it will be readily apparent to those skilled in the art that various changes in form and arrangement of parts may be made to suit requirements without departing from the spirit and scope of the invention.

What is claimed is:

1. A rolling mill including spaced-apart mill housings each having a window to receive and support a bearing chock on one of the ends of each of at least a pair of rolls for processing workpieces, the combination therewith of:

screwdown housing means extending within the windows of the mill housings for independent support between the bearing chocks of one roll and the mill housings, nut members carried by the screwdown housing means, a pair of screws each threadedly engaged with one of said nut members, means carried by the screwdown housing means for producing relative rotation between the screws and nut members, locking means supported by the screwdown housing means for linear constrained displacement of the pair of screws relative to the nut members by relative rotation therebetween, and fastening means for releasably attaching the screwdown housing means on the mill housings within the windows thereof independently of said bearing chocks such that the nut members and the screws extend between the chocks of one roll and the mill housings for adjustably positioning one roll relative to the other roll.

2. The rolling mill according to claim 1 wherein said mill housings include post sections extending between top and bottom beam sections, and wherein the length of each of said screws is less than the height of either the top or bottom beam section.

3. The rolling mill according to claim 2 wherein said screws each has threads along a length thereof which are no greater than the length of threads in each of said nut members.

4. The rolling mill according to claim 1 wherein said screwdown housing means comprises discrete screwdown housing members each having a width which is greater than the thickness of either mill housing.

5. The rolling mill according to claim 4 wherein each of said discrete screwdown housing members projects from the window at opposite sides of the mill housings supported thereby and independently removable therefrom.

6. The rolling mill according to claim 1 wherein said mill housings are each essentially comprised of a machined steel plate.

7. The rolling mill according to claim 6 wherein the window of each of the mill housings is defined by a generally planar surface engaged by said screwdown housing means.

8. The rolling mill according to claim 1 wherein said fastening means includes a bracket attached to each mill housing to define an aligned extension to the window thereof to releasably support the screwdown housing means.

9. The rolling mill according to claim 8 wherein said fastening means further includes threaded bolts extending between said bracket and said screwdown housing means.

10. The rolling mill according to claim 1 wherein said screwdown housing means includes discrete screwdown housings each carrying one of said nut members, the nut members carried by each screwdown housing being coupled with said means for producing relative rotation.

11. The rolling mill according to claim 10 wherein each of said nut members carries worm gear teeth, said means for producing relative rotation includes a worm gear to mesh with the worm gear teeth of each nut member, each worm gear having a drive shaft rotatably supported by one of said discrete screwdown housings.

12. The rolling mill according to claim 11 wherein said means for producing relative rotation further includes a drive shaft extension connected by a coupling to the drive shaft for one of the worm gears while the drive shaft is supported for rotation by the screwdown housing carrying the other of said worm gears.

13. The rolling mill according to claim 12 wherein said means for producing relative rotation further includes means to selectively couple the drive shafts of each of said worm gears for synchronous rotation.

14. The rolling mill according to claim 13 wherein said means to selectively couple includes two ratchet members joined together by a link bar.

15. The rolling mill according to claim 13 wherein the drive shaft for one of said worm gears is tubular and receives said drive shaft extension, and wherein said means to selectively couple includes an annular member secured to each of said drive shaft extensions and the tubular drive shaft, and a pin member to releasably interlock said annular members.

16. The rolling mill according to claim 1 wherein said locking means includes interfitting surfaces for slideable movement in a direction parallel to the rotational axis of said screws.

17. The rolling mill according to claim 1 wherein said locking means includes for each of said screws, a shaft, a key carried by said shaft and a locking plate secured to said housing means while supporting said shaft, said screws having an axially-bored recess at one end with a key slot to slideably receive said shaft and key.

18. The rolling mill according to claim 1 wherein said locking means includes for each of said screws, a lock plate secured to one end of said screw, a locking pin secured to said lock plate for projecting therefrom, said screwdown housing means including a recess to receive said locking pin for slideable movement.

* * * * *